US006276022B1

(12) United States Patent
Gallacher

(10) Patent No.: US 6,276,022 B1
(45) Date of Patent: Aug. 21, 2001

(54) BACKSCRUBBER WITH REMOVABLE WASHING ELEMENT

(76) Inventor: Scott Eric Gallacher, 613 Briar Spring Cir., Midvale, UT (US) 84047

( * ) Notice: Subject to any disclaimer, the term of this patent is extended or adjusted under 35 U.S.C. 154(b) by 0 days.

(21) Appl. No.: 09/442,016

(22) Filed: Nov. 17, 1999

(51) Int. Cl.[7] ..... A47K 7/02

(52) U.S. Cl. ..... 15/209.1; 15/142; 15/147.2; 15/229.11

(58) Field of Search ..... 15/145, 147.1, 15/147.2, 208, 209.1, 210.1, 229.11, 229.13

(56) References Cited

U.S. PATENT DOCUMENTS

| | | | | |
|---|---|---|---|---|
| 770,588 | * | 9/1904 | Koch | 15/209.1 |
| 1,291,131 | * | 1/1919 | Radel | 15/147.2 |
| 1,863,778 | * | 6/1932 | Welsh | 15/209.1 X |
| 2,048,103 | * | 7/1936 | Cleaves | 15/209.1 X |
| 2,233,831 | * | 3/1941 | Burke | 15/210.1 |
| 2,719,315 | * | 10/1955 | Sheehan | 15/210.1 |
| 2,816,313 | * | 12/1957 | Beck et al. | 15/210.1 |
| 5,426,810 | * | 6/1995 | Rones | 15/229.13 |
| 5,592,713 | * | 1/1997 | Rones | 15/210.1 |
| 5,944,032 | * | 8/1999 | Masterson | 15/229.11 X |
| 6,092,258 | * | 7/2000 | Chen | 15/209.1 |

* cited by examiner

*Primary Examiner*—Mark Spisich
(74) *Attorney, Agent, or Firm*—L Ronald Jorgensen

(57) ABSTRACT

A backscrubber assembly adapted to hold a washing element with a cord. The backscrubber assembly comprises a handle, and a bowl permanently attached to the handle, the bowl being sized and shaped to cradle the removable washing element. The backscrubber uses the cord to attach and detach the washing element. When attached, the cord holds the washing element firmly in the bowl. When the cord is detached, the washing element is separate and free from the backscrubber assembly. In one embodiment, the backscrubber assembly has a slit in the bowl. The slit has a first pressure point and a second pressure point. The first pressure point and the second pressure point are directed towards each other so that when the cord of the washing element in placed in the slit, the first and second pressure points squeeze the cord between them, thus securing the cord by friction.

10 Claims, 4 Drawing Sheets

BACKSCRUBBER WITH REMOVABLE WASHING ELEMENT

BACKGROUND

1. Field of the Invention

This invention relates to a backscrubber with a removable washing element.

2. State of the Art

Because it is awkward to reach one's own back, many people use backscrubbers to lather their backs while bathing or showering. Most of these backscrubbers consist of a sponge attached to a handle. However, within the last few years, nylon mesh scrubbers have become increasingly popular. Nylon mesh scrubbers, sometimes called scrubbies or nylon mesh puffs, are made of a nylon mesh secured by a cord to form a ball or puff. Since they readily absorb soap and other skin cleaners, many people use nylon mesh scrubbers for lathering. Thus, some people have both a backscrubber and a nylon mesh scrubber in their already crowded bathtubs or shower stalls. There is a need for a backscrubber that can use the same nylon mesh scrubber one uses to lather the rest of the body.

SUMMARY OF THE INVENTION

It is an object of the invention to provide a backscrubber assembly to hold a nylon mesh scrubber.

It is also an object of the invention to provide a backscrubber assembly that allows a person to use the same nylon mesh scrubber as a backscrubber and for lathering other parts of the body.

It is an additional object of the invention to provide a backscrubber assembly that is easy to manufacture.

It is a further object of the invention to provide a backscrubber assembly that is easy to use.

It is another object of the invention to provide a backscrubber assembly that can be used with an off-the-shelf nylon mesh scrubber.

These above objects are realized through a backscrubber assembly to hold a removable washing element such as a nylon mesh scrubber. The removable washing element includes a cord. The backscrubber assembly has a handle and a bowl permanently attached to a handle. The bowl is sized and shaped to cradle the washing element. The backscrubber assembly also includes means for attaching and detaching the cord. When the cord is attached, the washing element is held firmly in the bowl. This allows a person to hold the handle and wipe the washing element against that person's back without the washing element slipping. When the cord is detached, the washing element is separate and free from the backscrubber assembly.

In one embodiment, the backscrubber assembly has a slit in the bowl. The slit has a first pressure point and a second pressure point. The first pressure point and the second pressure point are directed towards each other so that when the cord of the washing element in placed in the slit, the first and second pressure points squeeze the cord between them, securing the cord by friction. The first and second pressure points of the slit may be off set in relation to each other. There may also be a means to kink the cord at a generally right angle to the direction that the cord goes through the slit to further secure the cord.

DETAILED DESCRIPTION

Figure 1:
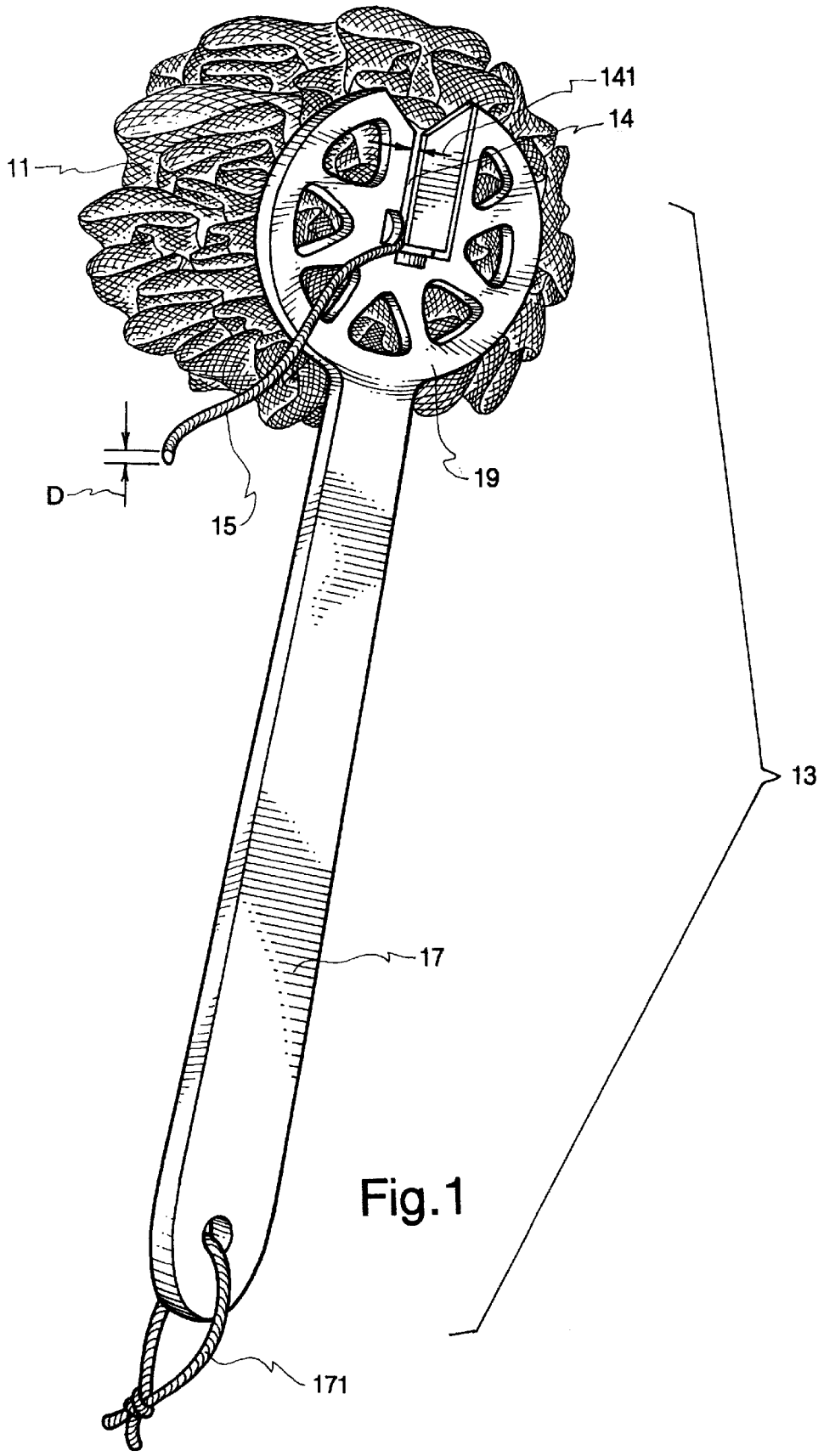
FIG. 1 shows a backscrubber assembly with removable washing element attached, made in accordance with the principles of the present invention.

As shown in FIG. 1, a backscrubber assembly 13 holds a removable washing element 11. In one embodiment, the removable washing element is a scrubber of nylon mesh material, held in generally in a ball or puff by a cord 15. Such scrubbers are well known in the art and are readily available to users. The backscrubber assembly include a handle 17 permanently fused to a bowl 19. The bowl is sized and shaped to cradle the removable washing element. The handle is about a foot long, a comfortable length for the consumer to use while scrubbing a back. A hanging string 171 or other means to hang the backscrubber may be on the handle. A vertical slit 14 pinches the cord 15 to hold it in place. The width of the vertical slit 141 is slightly smaller than the diameter D of the cord. There must be enough flex in the vertical slit to allow give as the cord is pulled threw the slit, yet the vertical slit must be firm enough to hold the cord in place. The backscrubber assembly is made of hard but flexible plastic.

Figure 2A:
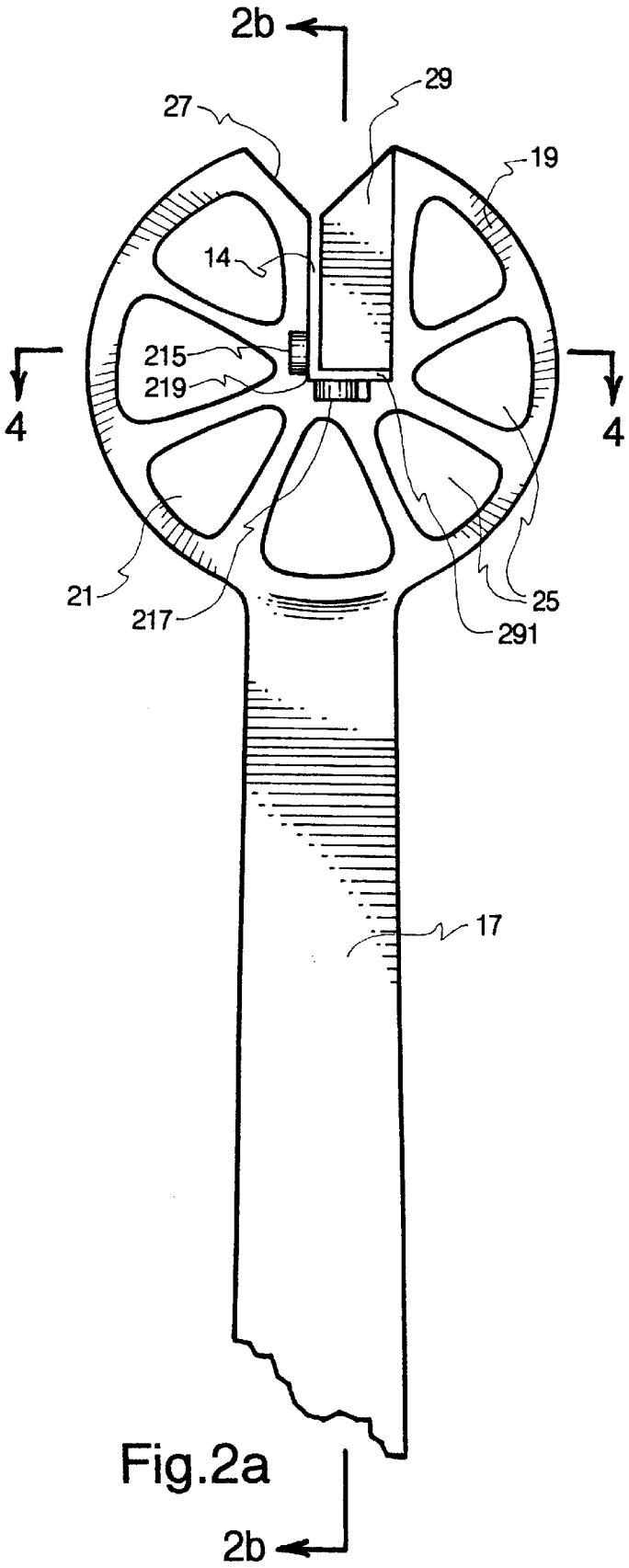
FIG. 2*a* shows details of the backscrubber assembly.
Figure 2B:
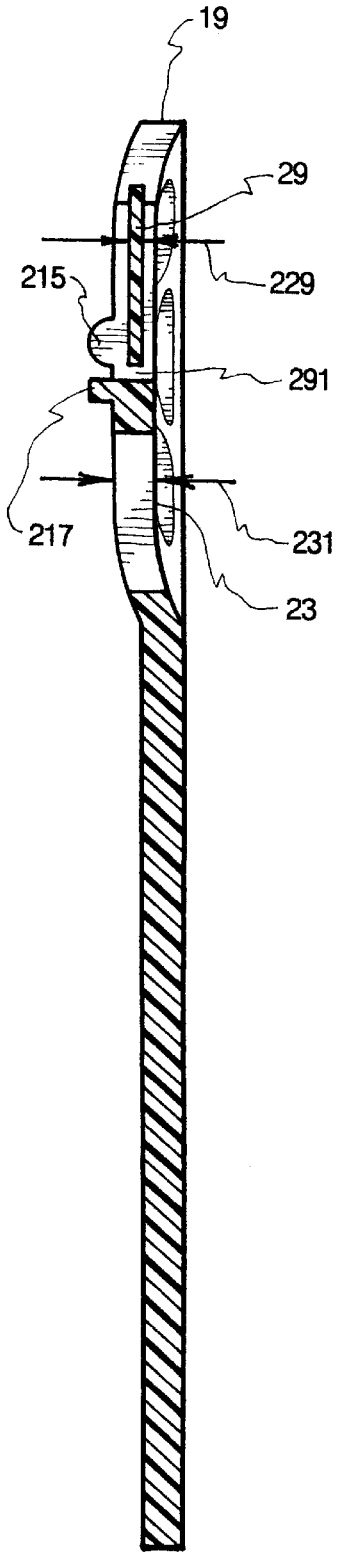
FIG. 2*b* shows a cut away view of the backscrubber assembly along the 2*b*—2*b* plane of FIG. 2*a*.

FIG. 2*a* and FIG. 2*b* shows details of the bowl 19 of the backscrubber assembly. FIG. 2*b* is a cut away view of the backscrubber assembly along the 2*b*—2*b* plane of FIG. 2*a*. As shown in FIG. 2*a*, the bowl is generally round. As shown in FIG. 2*b*, the surface of the bowl 23 is generally concave to cradle the removable washing element. Cut-outs 25 decrease the weight of the bowl. A V shaped cut 27 helps the user guide the cord into the vertical slit 14. Because the bowl has to be firm to support the removable washing element, the bowl may lack the flexibility required for the vertical slit. Thus, a portion of the bowl is shaved away to form a thin blade 29 along one edge of the vertical slit. As shown in FIG. 2*b*, the width of the blade 229 is thinner than the width of bowl 231. A horizontal slit 291 separates a portion of the blade from the bowl to increase the flexibility of the blade. The width of the horizontal slit must be considerably smaller than the diameter of the cord, so that the cord will not slip into horizontal slit. A vertical tab 215 and a horizontal tab 217, generally at right angles to each other, form a gap 219 slightly smaller than the diameter of the cord.

Figure 3C:
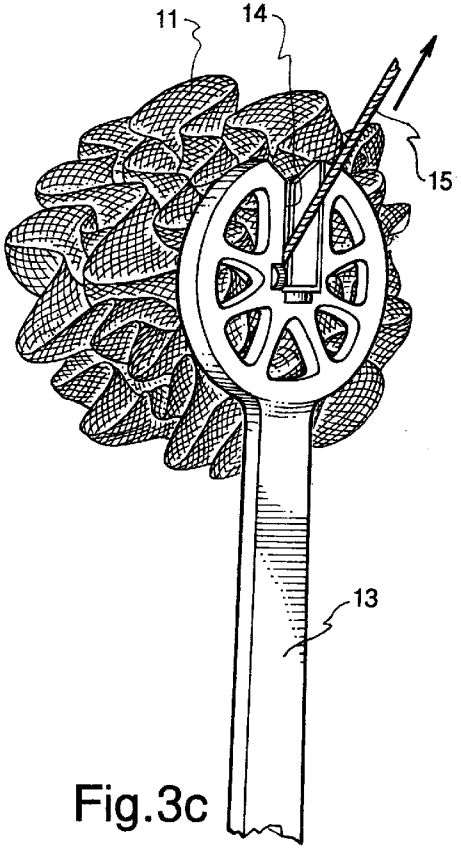
FIG. 3*a*, FIG. 3*b*, and FIG. 3*c* show the operation of the backscrubber assembly.
Figure 3B:
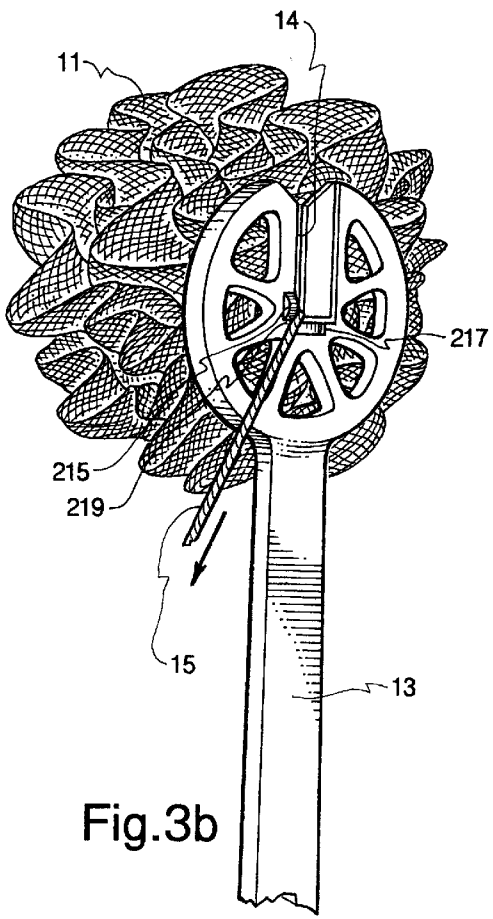
Figure 3A:
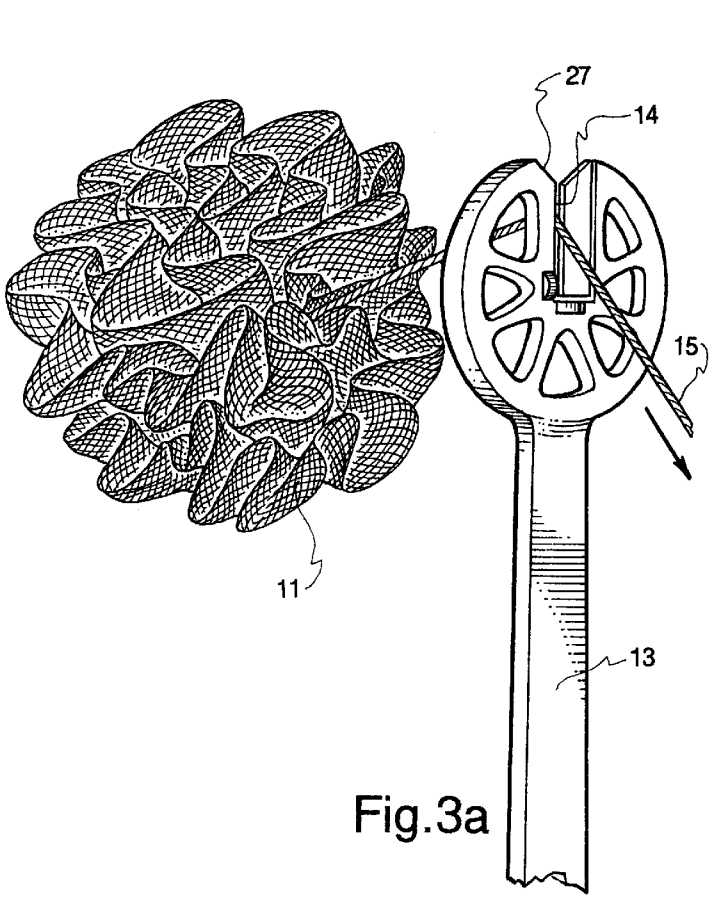

FIG. 3*a*, FIG. 3*b*, and FIG. 3*c* show steps in the operation of the backscrubber assembly. As shown in FIG. 3*a*, the user attaches the removable washing element by pulling the cord through the V shaped cut into the vertical slit 14. As shown in FIG. 3*b*, the user then pulls the cord through the gap 219 between the vertical tab 215 and the horizontal tab 217. The tabs kink the cord at a generally right angle to the direction of the cord through the slit. This kink keeps the cord from slipping as the backscrubber is used. As shown in FIG. 3*c*, the user pulls the cord out of the vertical slit to remove the removable washing element 11.

Figure 4:
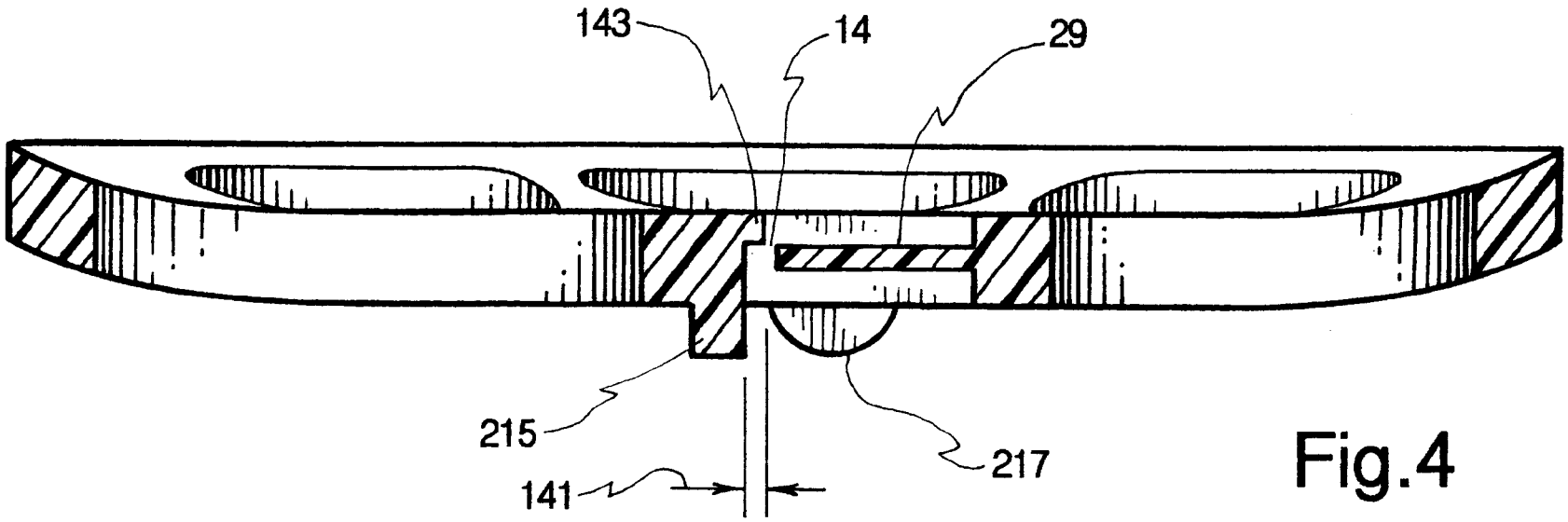
FIG. 4 shows a cut away view of the backscrubber assembly along the 4—4 plane of FIG. 2*a*.

Details of the vertical slit 14 are shown in FIG. 4. FIG. 4 shows a cut away view of the bowl and the blade 29 looking down along the 4—4 plane of FIG. 2*a*. As noted above in the discussion about FIG. 1, the width of the vertical slit 141 is slightly smaller than the diameter of the cord. A lip 143 extends along the side of the vertical slit opposing the blade. This lip increases the hold on the cord when the cord is in place. The lip forms a first pressure point. The edge of the blade forms a second pressure point. The first pressure point and the second pressure point are directed towards each other so that when the cord is in the slit, the first and second pressure points squeeze the cord between them, thus securing the cord by friction. Note that the lip and the blade are off-set. This off-set bends the cord rather than pinches the cord. This secures the cord without unduly fraying the cord.

The above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

I claim:

1. A backscrubber assembly to hold a washing element, the washing element having a cord, the backscrubber assembly comprising:

a handle; and a bowl permanently attached to the handle, the bowl being sized and shaped to cradle the washing element;

the bowl having a slit, the slit having a first pressure point and a second pressure point, the first pressure point and the second pressure point being directed towards each other so that when the cord of the washing element in placed through the slit, the first and second pressure points squeezes the cord between them, securing the cord by friction, the first and second pressure points of the slit being off set in relation to each other so that the cord is slightly bent when between the first and second pressure point;

so that when the cord is attached, the washing element is held firmly in the bowl, and when the cord is detached, the washing element is separate and free from the backscrubber assembly.

2. The backscrubber assembly of claim 1, further comprising a means to hold the cord at a generally right angle to the direction that the cord goes through the slit.

3. The backscrubber assembly of claim 2, wherein the means to hold the cord at a generally right angle to the direction that the cord goes through the slit consists of a first tab and a second tab with a gap between the first tab and second tab to secure the cord.

4. The backscrubber assembly of claim 3, wherein the first tab and second tab are generally at right angles to each other.

5. A backscrubber assembly for washing the back of a person comprising:

a washing element, the washing element having a cord permanently attached;

a handle;

a bowl permanently attached to the handle, the bowl being sized and shaped to cradle the washing element; and means for attaching and detaching the cord, so that when the cord is attached, the washing element is held firmly in the bowl, allowing the person to hold the handle and wipe the washing element against person's back without the washing element slipping, and when the cord is detached, the washing element is separate and free from the backscrubber assembly.

6. The backscrubber assembly of claim 5, wherein the means for attaching and detaching the cord is a slit in the bowl, the slit having a first pressure point and a second pressure point, the first pressure point and the second pressure point being directed towards each other so that when the cord of the washing element in placed through the slit, the first and second pressure points squeezes the cord between them, thus securing the cord by friction.

7. The backscrubber assembly of claim 6, wherein the first and second pressure points of the slit are off set in relation to each other so that the cord is slightly bent when between the first and second pressure point, thus securing the cord by friction.

8. The backscrubber assembly of claim 6, wherein the means for securing the cord further consists of a means to hold the cord at a generally right angle to the direction that the cord goes through the slit.

9. The backscrubber assembly of claim 8, wherein the means to hold the cord at a generally right angle to the direction that the cord goes through the slit consists of a first tab and a second tab with a gap between the first tab and second tab to secure the cord.

10.The backscrubber assembly of claim 9, wherein the first tab and second tab are generally at right angles to each other.

* * * * *